US006981282B2

(12) United States Patent
Marty et al.

(10) Patent No.: US 6,981,282 B2
(45) **Date of Patent: *Jan. 3, 2006**

(54) SYSTEMS AND METHODS FOR TRANSFORMABLE SUITS

(75) Inventors: Justin Douglas Marty, Salt Lake City, UT (US); Joseph Edward Marty, North Salt Lake, UT (US); Joshua Craig Pace, Salt Lake City, UT (US)

(73) Assignee: Z Gear, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/665,344

(22) Filed: Sep. 20, 2003

(65) Prior Publication Data

US 2004/0128731 A1 Jul. 8, 2004

Related U.S. Application Data

(63) Continuation-in-part of application No. 10/638,990, filed on Aug. 11, 2003, which is a continuation-in-part of application No. 10/251,177, filed on Sep. 20, 2002, now Pat. No. 6,742,225.

(51) Int. Cl.
*A41D 13/00* (2006.01)

(52) U.S. Cl. ..... 2/69

(58) Field of Classification Search ..... 2/93, 2/94, 79, 227, 102, 108, 69, 69.5, DIG. 1, 2/84, 86, 114, 115, 2.17, 243.1, 71, 72, DIG. 2
See application file for complete search history.

(56) References Cited

U.S. PATENT DOCUMENTS

| | | | | |
|---|---|---|---|---|
| 361,250 A | | 4/1887 | Wright | |
| 2,136,879 A | | 11/1938 | Harber et al. | 24/205 |
| 2,178,885 A | | 11/1939 | Buffer et al. | 24/205 |
| 2,274,510 A | | 2/1942 | Wohl et al. | 2/270 |
| 2,483,057 A | | 9/1949 | Levering | 24/205 |
| 2,622,248 A | | 12/1952 | Schayer | 2/80 |
| 2,744,253 A | * | 5/1956 | Freedman | 2/80 |
| 2,856,609 A | | 10/1958 | Persico et al. | 2/269 |
| 2,889,605 A | | 6/1959 | Morin | 24/205 |
| 3,170,167 A | | 2/1965 | Isaacs | 2/269 |
| 3,214,771 A | | 11/1965 | Treiber | 2/270 |
| 3,219,084 A | | 11/1965 | Ausnit et al. | 150/3 |
| 3,328,809 A | | 7/1967 | Payne et al. | 2/269 |
| 3,448,463 A | | 6/1969 | Milone | 2/234 |
| 3,726,329 A | | 4/1973 | Dean | 158/28 R |
| 3,771,169 A | * | 11/1973 | Edmund | 2/2.17 |
| 4,112,556 A | | 9/1978 | Flaum et al. | 24/205.1 R |
| 4,149,275 A | | 4/1979 | Sanchez | 2/269 |
| 4,158,892 A | * | 6/1979 | Gonzales | 2/69.5 |
| 4,200,938 A | | 5/1980 | LeTourneau | 2/269 |
| 4,485,534 A | | 12/1984 | Pilie et al. | 24/384 |
| 4,492,006 A | | 1/1985 | Ishii | 24/382 |
| 4,543,670 A | | 10/1985 | Ehring | 2/85 |
| 4,602,389 A | | 7/1986 | Brown | 2/243 R |
| 4,608,715 A | * | 9/1986 | Miller et al. | 2/1 |
| 4,631,753 A | | 12/1986 | Ehring | 2/85 |
| 4,757,577 A | | 7/1988 | Freeman | 24/382 |
| 4,896,379 A | | 1/1990 | Kape | 2/269 |
| 4,985,936 A | | 1/1991 | Jones | 2/269 |

(Continued)

*Primary Examiner*—Tejash Patel
(74) *Attorney, Agent, or Firm*—Julie H. Gheem; Kirton & McConkie

(57) ABSTRACT

Methods and systems for transforming a volume of material into pant legs by means of a transforming fastener. The transforming fastener has multiple tracks, each track having a pair of matable rows. A slider coupled to the rows transforms the volume of material into pant legs when the slider moves along the rows. The slider accomplishes this transformation by fastening one of the pair of rows while simultaneously unfastening another of the pair of rows.

54 Claims, 15 Drawing Sheets

U.S. PATENT DOCUMENTS

| | | | | |
|---|---|---|---|---|
| 5,031,944 | A | 7/1991 | Keyaki | 292/307 R |
| 5,033,127 | A | 7/1991 | Schmeltz | 2/269 |
| 5,044,015 | A | 9/1991 | Howard | 2/269 |
| 5,072,454 | A | 12/1991 | Trahan | 2/70 |
| 5,088,128 | A | 2/1992 | Kape | 2/269 |
| 5,153,944 | A | 10/1992 | Teel | 2/243 R |
| 5,170,505 | A | 12/1992 | Rohrer | 2/69 |
| 5,208,920 | A | 5/1993 | Schaefer et al. | 2/269 |
| 5,299,323 | A | 4/1994 | Schaefer et al. | 2/93 |
| 5,490,294 | A | 2/1996 | Kramer | 5/413 |
| 5,535,453 | A | 7/1996 | Howard | 2/269 |
| 5,539,932 | A | 7/1996 | Howard | 2/269 |
| 5,575,010 | A | 11/1996 | Chung | 2/227 |
| 5,608,915 | A | 3/1997 | Libit | 2/228 |
| 5,697,130 | A | 12/1997 | Smith | 24/383 |
| 5,774,892 | A | 7/1998 | Tisdale et al. | 2/69 |
| 5,787,511 | A | 8/1998 | Garside | 2/269 |
| 5,794,265 | A | 8/1998 | Reich | 2/125 |
| 5,815,837 | A | 10/1998 | Christman et al. | 2/158 |
| 5,894,600 | A | 4/1999 | Chenefront | 2/69 |
| 5,953,758 | A | 9/1999 | Foster | 2/268 |
| 6,047,404 | A | 4/2000 | Blanks, I | 2/69 |
| 6,058,578 | A | 5/2000 | Lan | 24/429 |
| 6,076,189 | A | 6/2000 | Christman et al. | 2/158 |
| 6,223,349 | B1 | 5/2001 | Roiser | 2/2.17 |
| 6,253,381 | B1 | 7/2001 | Kelley | 2/125 |
| 6,317,894 | B1 | 11/2001 | Blechman | 2/269 |
| 6,349,413 | B1 | 2/2002 | Rose et al. | 2/126 |
| 6,415,482 | B1 | 7/2002 | Pontaoe | 24/429 |
| 6,742,225 | B2 | 6/2004 | Marty et al. | 24/382 |
| 2004/0055118 | A1 | 3/2004 | Marty et al. | 24/382 |
| 2004/0128730 | A1 | 7/2004 | Marty et al. | 2/69 |
| 2005/0034206 | A1 | 2/2005 | Marty et al. | 2/69 |

* cited by examiner

SYSTEMS AND METHODS FOR TRANSFORMABLE SUITS

RELATED APPLICATIONS

This application claims priority to U.S. Utility patent application Ser. No. 10/251,177, filed Sep. 20, 2002, titled CONNECT-RELEASE ZIPPING SYSTEM, now U.S. Pat. No. 6,742,225, and to U.S. Utility patent application Ser. No. 10/638,990, filed Aug. 11, 2003, titled MULTI-TRACK FASTENING SYSTEM.

BACKGROUND

1. Field of the Invention

The present invention relates generally to methods and systems for transforming, via a fastening mechanism, a volume or compartment of material into varied shapes or configurations. More particularly, the present invention relates to a transformable volume of material that can be selectively divided by a slider that connects two sides of material while simultaneously disconnecting two other sides of material.

2. Background Information

Many existing systems that provide for alternative configurations of volumes of material involve the use of fasteners. One popular type of fastener often used with transformable volumes is a zipper. A typical zipper includes a track or chain having two rows of teeth that interlock with each other. A zipper slider is located on the track so that a user can pull on a pull tab on the zipper slider in order to move the slider up and down the track, thereby causing the zipper to zip open and closed as desired. Some zippers have a stop at one or both ends of the zipper to stop the zipper slider from moving off of the track. Some zippers are designed so that the zipper slider is never removed from the track; other zippers are designed to allow the zipper slider to be removed from one row of the track, thereby allowing the material attached to one row of teeth to be further separated from the material attached to the other row of teeth.

One existing system that provides for alternative volume configurations uses multiple rows of zipper teeth. In particular, this system includes three adjacent rows of zipper teeth, the central row of which has two opposing zipper sliders each located at opposite ends of the row. The user may thus choose to attach one of the adjacent rows to one of the zipper sliders so that the central row and the adjacent row can be zipped up to form a first zipper track. Alternatively, the user may choose to attach the other adjacent row of teeth via the opposing zipper slider so that this adjacent row and the central row can be zipped up to form a second zipper track. This multi-zipper system is used to vary the size or volume of a laundry bag, for example.

Another volume modifying system involves two parallel zippers that lie on top of each other. The user can choose to use either of the zippers to zip up an article of clothing in which the zippers are incorporated. For example, this system, when incorporated into a pair of pants, allows a person to choose to zip up either the first zipper or the second zipper, thereby effectively creating two alternative waist sizes of pants within a single pair of pants. This particular volume modifying system can thus be useful in accommodating weight gain or loss by the person who wears the clothing.

Yet another volume modifying system has an exchange portal through which the ends of a pair of zipper teeth are inserted and through which each row of teeth are thereby exchanged and mated with another pair of zipper teeth. This system requires an elongated extension at the end of the row of zipper teeth that the user must manually align and insert into a small slot in the exchange portal. This volume transforming system allows an occupant inside a hazardous chemical jumpsuit to attach the jumpsuit to zipper teeth on the side of a tent without exposing the occupant or tent to the outside environment.

SUMMARY AND OBJECTS OF THE INVENTION

The present invention basically comprises methods and systems for transforming a volume of material into compartments comprising pant legs by means of a transforming fastener. The transforming fastener has multiple tracks, and each track has a pair of matable rows. A slider coupled to the rows transforms the volume of material into compartments comprising pant legs when the slider moves along the rows. The slider accomplishes this transformation by, when sliding along the rows, fastening together one of the pair of rows while simultaneously unfastening another of the pair of rows to cause the rows to preferably interchange with each other. In some embodiments of the present invention, this transformation takes place without substantially exposing the interior of the volume to the environment exterior to the volume of material.

Some embodiments of the present invention have arm sleeves in the volume of material, some of which are formed by a transformable fastener. Some embodiments of the present invention have a cinching system for allowing the user to selectively shorten the length of the pant legs. Also, the slider of the transformable fastener can share a track with a standard zipper slider in some embodiments of the present invention. The volume of material may also have various standard zippers placed therein to allow one or more of the user's arms, hands, and/or feet to extend from the volume of material.

Accordingly, it is an object of some embodiments of the present invention to provide a volume of material that a user may selectively compartmentalize into volumes suitable for use as pant legs.

Another object of some embodiments of the present invention is to provide a compartmentalizing baby suit that is transformable by a slider that connects two sides of material while simultaneously disconnecting two other sides of material.

Another object of some embodiments of the present invention is to provide an easy-to-use multi-fastener suit that can alternate between a sleeping bag and a jumpsuit without exposing the wearer to the exterior environment.

Yet another object of some embodiments of the present invention is to provide a suit made of a volume of material or fabric and that can transform into alternative configurations, both of which have the same quantum of volume, the transformation taking place without exposing any contents inside the suit to the exterior environment.

A further object of some embodiments of the present invention is to provide a simple multi-zippered system that transforms a bag enclosing an occupant's legs into a jumpsuit without requiring the occupant to exit the bag.

BRIEF DESCRIPTION OF THE DRAWINGS

The foregoing and other objects and features of the present invention will become more fully apparent from the accompanying drawings when considered in conjunction with the following description and appended claims. Other objects will likewise become apparent from the practice of the invention as set forth hereafter. Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

One purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are generally designated by like alphanumeric characters throughout.

Figure 1A:
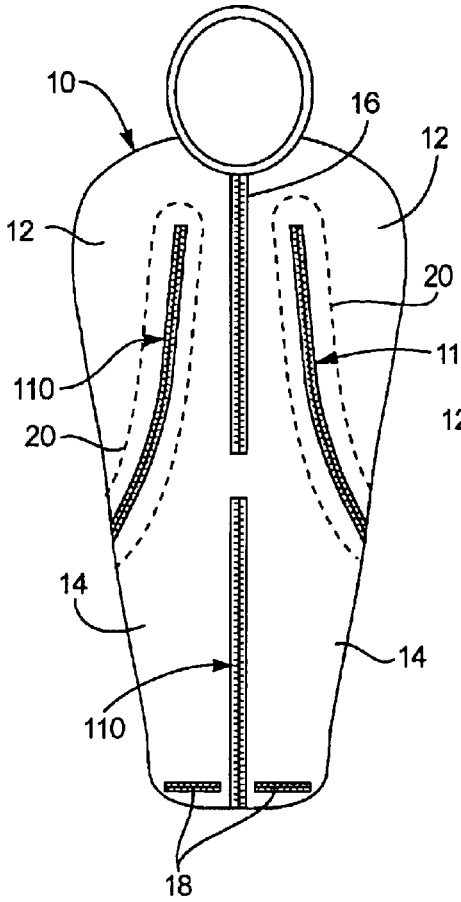
FIGS. 1A and 1B are plan views showing some embodiments of the present invention.
Figure 1B:
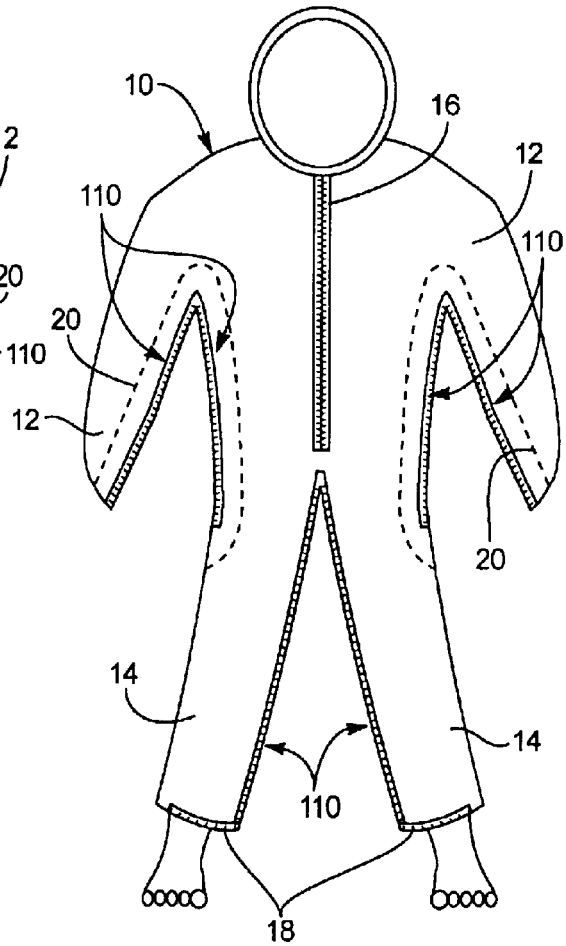

FIGS. 1A and 1B show a volume of material 10 and transforming fasteners 110 incorporated into the volume of material 10 in accordance with some embodiments of the present invention. The volume of material 10 comprises material or fabric and is designed to be worn by a user. The volume of material 10 comprises material capable of serving as pant legs 14 or, in other words, as compartments, preferably substantially cylindrically shaped, suitable for encasing the wearer's legs and/or feet. In some embodiments, the legs 14 have a standard zipper 18 to allow the user's feet to exit the volume of material 10 while the user is wearing the volume of material 10. Also, some embodiments of the present invention have durable material at the bottom of the pant legs 14 such as the plastic material often found in pajama feet of baby pajamas. The durable material protects the user's feet as the user walks around when wearing the volume of material 10.

In some embodiments of the present invention, the volume of material 10 comprises material capable of serving as arms or arm sleeves 12 or, in other words, as compartments suitable for enclosing the wearer's arms and/or hands. Some embodiments may further include a standard zipper 16 coupled to the volume of material 10 to allow a user to thereby enter and exit the volume of material 10. Stretchable or elasticized fabric 20 may also be placed between one or more of the transforming fasteners 110 and the volume of material 10 in order to help the slider (described further herein) of the transforming fastener slide smoothly along the tracks (also described further herein).

The transforming fasteners 110 each comprise multiple tracks, each track comprising a pair of matable rows that preferably comprise zipper teeth. Each transforming fastener 110 also comprises a slider slidably coupled to the rows for transforming the volume of material 10 between alternative configurations or formations. The slider accomplishes this transformation by fastening one of the pair of rows together while simultaneously unfastening another of the pair of rows, thereby causing the rows to preferably interchange. Examples of transforming fasteners, tracks, rows, and sliders will be described further herein.

The rows, whether or not they comprise zipper teeth, can be made of any type of material, including metal, plastic, and nylon, and can have any variety of shapes, weights, and lengths. In addition, the transforming fastener 110 can have any number of rows or tracks, and the rows need not be physically completely separate from each other—for example, two rows could comprise both ends of a long continuous row that has been bent in the middle so as to form the shape of a "U."

In some embodiments of the present invention, the slider of the transforming fastener 110 is irremovably coupled to the tracks in that the slider is not designed to be completely removed by the user from any of the rows, unlike with some standard zippers found on jackets, for example (wherein a standard zipper slider is detachable from one row of zipper teeth at the bottom of the jacket in order to allow a person wearing the jacket to remove the jacket or otherwise wear it open). However, some embodiments of the present invention contemplate a slider that can indeed be removed from one or more of the rows, some of the rows of which might include a standard zipper pin at one end (well known in the art), the zipper pin being designed to be manually insertable into a standard zipper box (also well known in the art) that is fixed to one end of a row.

Each of the transforming fasteners 110 divide or compartmentalize the volume of material 10 so as to transform it from a first undivided formation or configuration to a second divided formation or configuration. For example, FIG. 1A shows the volume of material 10 in the formation of a bag, or, in other words, a compartment suitable for enclosing a user's legs and/or feet, such as those found in a sleeping bag or baby bunting. FIG. 1A shows a bag formation in which the material comprising the arm sleeves 12 and pant legs 14 are part of the sides of the bag so that the interior volume enclosed by the volume of material 10 is substantially undivided. In contrast, FIG. 1B shows the volume of material 10 in the formation of a jumpsuit, or, in other words, a formation in which the user's legs are separately enclosed by the volume of material 10, the latter formation preferably but not necessarily including arm sleeves 12 that separately enclose the user's arms. In this formation, the arm sleeves 12 and pant legs 14 are compartments that are substantially divided from the rest of the volume of material 10. In light of this example of the transformation between the configuration in FIG. 1A and the configuration in FIG. 1B, it will be noted that in the first formation, as defined herein, the relevant volume (whether it be the volume near the user's arms or the volume near the user's legs) is substantially undivided; in the second formation, the relevant volume has been divided. The transforming fasteners 110 can cause this transformation between the first and second formations (and vice versa), as will be explained further herein.

Figure 2:
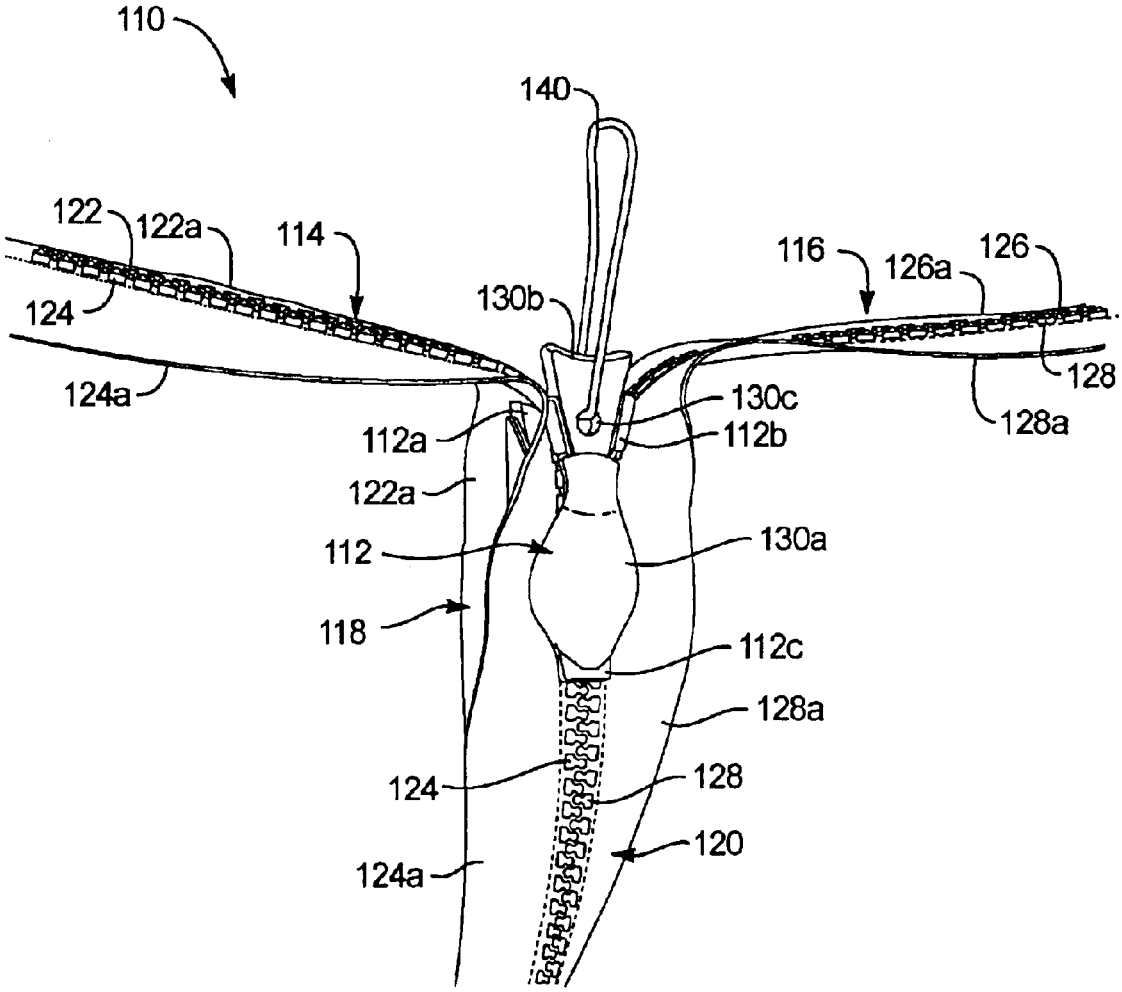
FIG. 2 is a perspective view showing one embodiment of a transforming fastener of the present invention.
Figure 3:
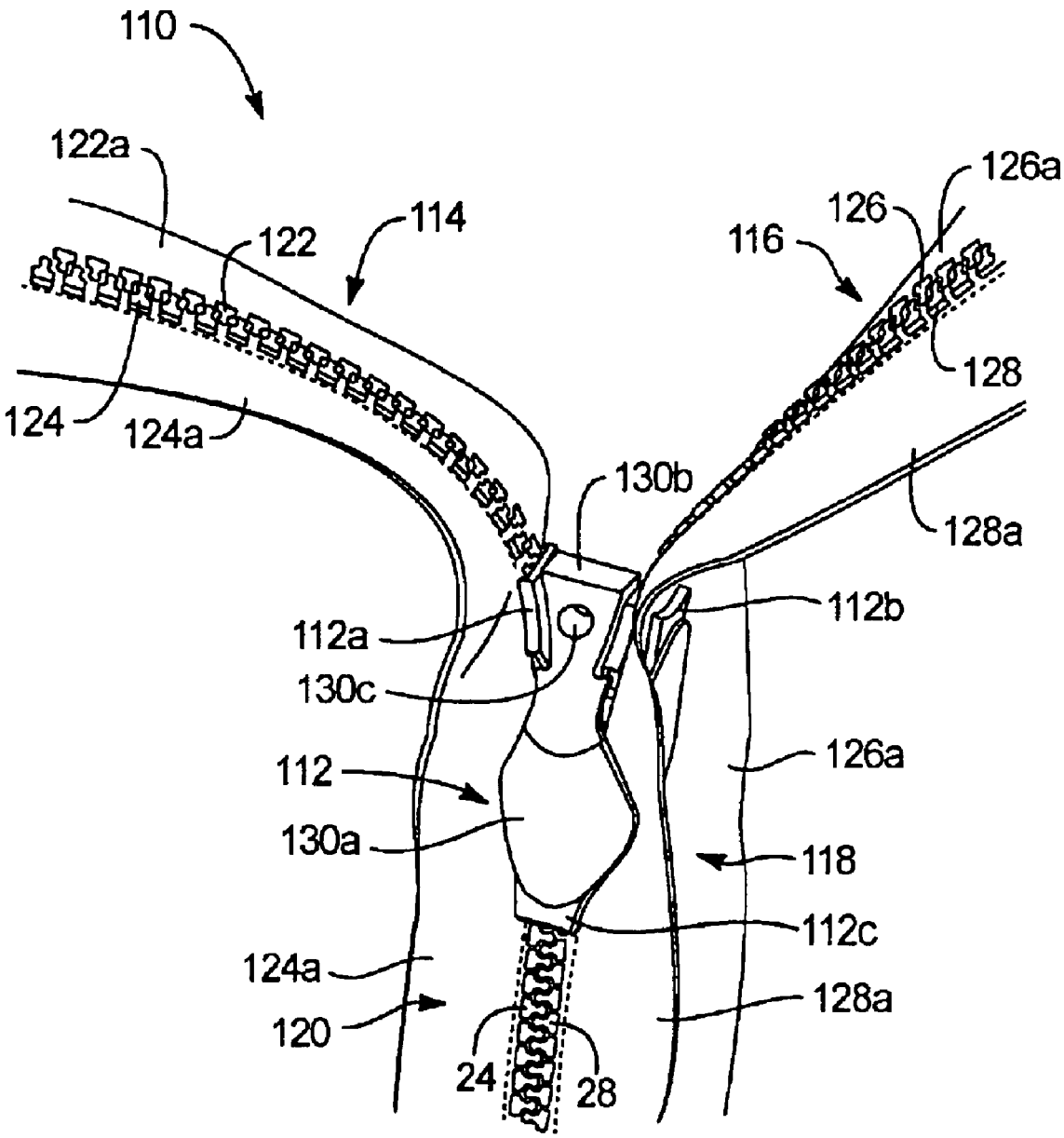
FIG. 3 is another perspective view of an embodiment of a transforming fastener.

FIGS. 2 and 3 show perspective views of one embodiment of the transforming fastener 110. This transforming fastener 110 basically comprises a first track 114, a second track 116, and a central slider or interchange 112. First track 114 comprises two rows 122 and 124, here shown as zipper teeth, that are matable with each other. Second track 116 also comprises two matable rows 126 and 128, here also shown as zipper teeth. The tracks 114 and 116 are coupled to the volume of material 10 via strips of tape or other connector material (that is, anything serving to directly connect the rows to the volume of material 10) 122*a*, 124*a*, 126*a*, and 128*a* extending from each side of the rows. Preferably, the rows 122, 124, 126, and 128 each comprise a row of teeth that interlock with each other as shown in FIGS. 2 and 3.

Figure 4:
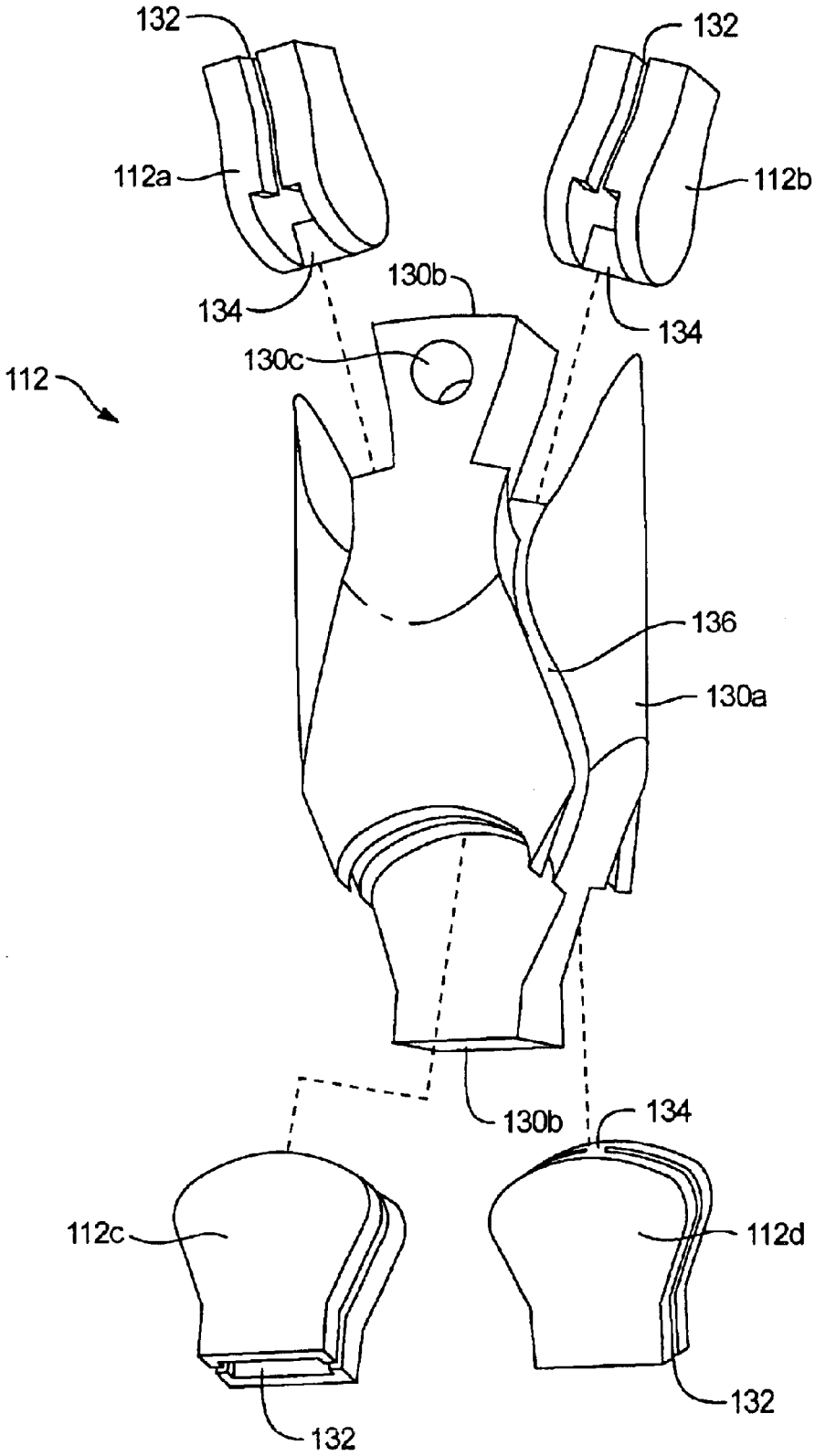
FIG. 4 is an exploded perspective view of one embodiment of a central slider of a transforming fastener of the present invention.

Central slider 112 is one embodiment of a slider comprising various parts, including slider parts 112*a* through 112*d* (an example of which can be seen best in FIG. 4). Central slider 112 closes or mates some of the rows together when it is slid along the tracks. Central slider 112 can also open or disengage some of the rows from each other when the central slider 112 is slid along the tracks.

When this central slider 112 is propelled along the tracks, the rows of the tracks interchange. For example, as can be seen in FIGS. 2 and 3, the rows 122, 124, 126, and 128 of the two tracks 114 and 116 interchange so as to re-form into tracks 118 and 120. At the top of FIGS. 2 and 3, it can be seen that track 114 comprises the mated rows 122 and 124, and track 116 comprises the mated rows 126 and 128.

FIGS. 2 through 4 show that the central slider 112 includes a contour or outer surface 130*a* that is preferably tapered or curved so as to allow a user to easily grasp the sides of the surface 130*a* and thereby either push or pull on the central slider 112 to propel the central slider 112 along the tracks. Outer surface 130*a* preferably includes one or more ends 130*b* upon which the user may push to propel the central slider 112 along the tracks. Note that in some embodiments, as in that shown in FIG. 2, end 130*b* extends out from the central slider 112. In other embodiments, as in that shown in FIGS. 3 and 6B, end 130*b* sits closer in with the rest of the central slider 112 (in FIG. 6B, the embodiment of the end 130*b* located at the left end of the central slider 112 has a curved indentation to more easily accommodate the user's finger when the user pushes against the end 130*b* to propel the central slider 112). A hole 130*c* can be optionally placed in central slider 112 to accommodate a pull cord 140 (see FIG. 2) that further facilitates the user's ability to propel the central slider 112 along the tracks.

Whether the central slider 112 is propelled by pushing or pulling on surface 130*a* or by tugging on pull cord 140, the means for propelling the central slider 112 preferably involves symmetrically balanced pressure exerted by the user upon the central slider 112. In other words, the sum of the user's vector forces exerted on the propulsion means preferably equals a vector force that aligns with the direction of desired movement of the central slider 112 along the tracks. Note that a typical pull tab located on only one side of the central slider 112 would cause the central slider 112 to lean in one direction when the pull tab is pulled; such a propulsion means is not symmetrically balanced.

Figure 6A:
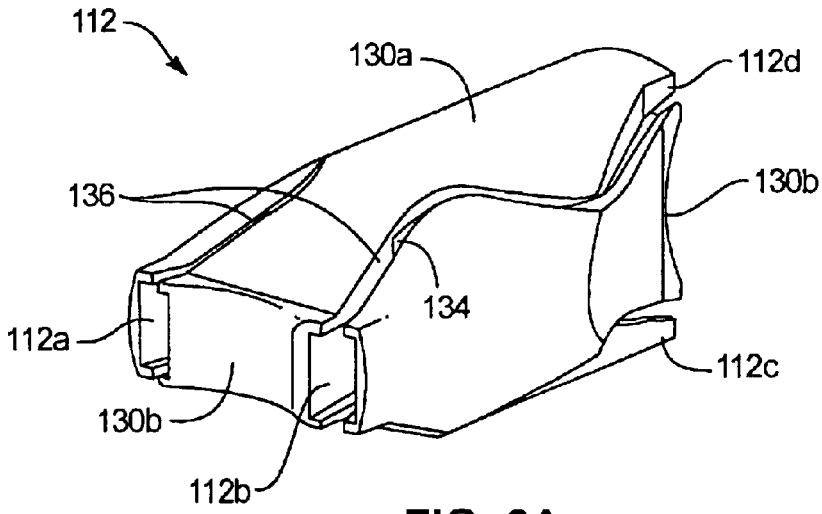
FIG. 6A is a perspective view of another embodiment of a central slider of a transforming fastener of the present invention.
Figure 6B:
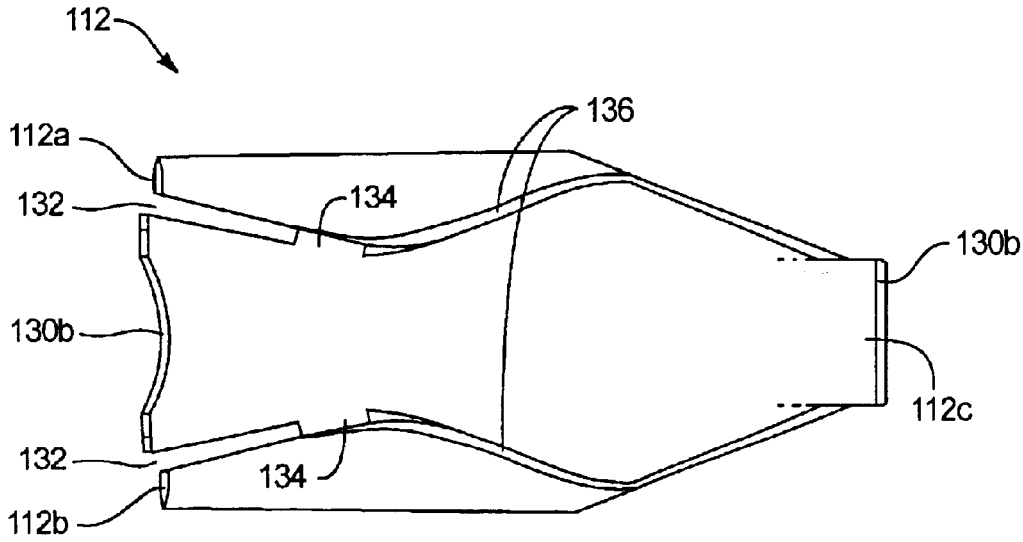
FIG. 6B is a side plan view of the embodiment shown in FIG. 6A.

During the assembly process of some embodiments of the central slider 112, the slider parts 112*a* through 112*d* are placed into the body of the central slider 112. The slider parts 112*a* through 112*d* may be insert molded, injection molded, snapped in, sonic welded, or otherwise coupled to the central slider 112. Some embodiments of the central slider 112, such as those shown in FIGS. 6A and 6B, are made of one integral piece that is formed, for example, by using a single mould.

Central slider 112 can be made of any sort of strong material, including stainless steel and plastic. In some embodiments, central slider 112 is made entirely of aluminum and is substantially hollow, such as the embodiment shown in FIG. 4 which generally resembles a substantially hollow cylinder. A substantially hollow central slider 112 enjoys the added advantage of being lightweight.

FIG. 4 is an exploded perspective view of an embodiment of a central slider 112 having slider parts 112*a* through 112*d* that enable the tracks 114, 116, 118, and 120 to enter and exit the central slider 112 at openings 132 so that the rows are in a closed, zipped-up, or mated state. The slider parts 112*a* through 112*d* cause the mated rows to disengage, preferably via a wedge 134 inside each of paths 136 (described in the next paragraph), in preparation for the row interchange to take place via the paths 136 inside the central slider 112. It will be noted that in the preferred embodiments of the present invention, openings 132 are angled so as to cause the rows to begin to rotate before the rows start to disconnect from each other (via the wedges 134) in preparation for interchange. However, some embodiments of the present invention also contemplate that the openings 132 need not be angled as such.

Central slider 112 includes paths 136 in which the tracks travel, causing the rows of the tracks to interchange as previously described. Paths 136 begin at the slider parts 112*a* through 112*d*, each of which preferably have openings 132 that are angled (for example, at the angle between vertical and the dotted line pointing to slider part 112*b* in FIG. 4) to facilitate the movement of the central slider 112 along the tracks (or, in other words, the movement of the tracks through the central slider 112). Additional preferred features that aid in such movement include: paths 136 that have gradual curves, ideally comprising a flattened or elongated helical shape such as the paths 136 shown in FIGS. 4 through 6B; paths 136 that run substantially through the outer portions of the central slider 112 (again like those shown in FIGS. 4 through 6B), as opposed to through the central cross section of the central slider 112; and paths 136 that are designed so as to allow at least a portion of the tape 122*a*, 124*a*, 126*a*, and 128*a* to move within the paths 136 along with their respective rows. In some embodiments, some or all of these preferred features that aid in moving the central slider 112 along the tracks, together allow the user to pull at the volume of material 10 coupled to the tapes 122*a*, 124*a*, 126*a*, and 128*a* and thereby conveniently propel the central slider 112 along the tracks without having to touch the central slider 112 as further described in the next paragraph. Also, in some embodiments of the present invention, these motion-aiding features serve to prevent or minimize the bunching of the volume of material 10 coupled to the tracks.

In some embodiments wherein the user need not touch the central slider 112 in order to propel it along the tracks, the user can propel the central slider 112 by pulling the sections of the volume of material 10 located on each side of the tracks away from each other. For example, with respect to the embodiment shown in FIG. 1A, a user might lift up his arms to thereby cause the central slider 112 to slide along the tracks and transform the top end of the volume of material 10 from the configuration shown in FIG. 1A to that shown in FIG. 1B. Likewise, a user can cause, without using his hands, the transformation of the bottom end of the volume of material 10 from a bag formation (such as that shown in FIG. 1A) to a formation comprising pant legs (such as that shown in FIG. 1B) by simply spreading apart his legs. Thus, the user can cause the central slider 112 to propel along the tracks and transform the volume of material 10 without even having to touch the central slider 112 or any extension thereon. In the preferred embodiments, angled openings 132 in the central slider 112 help facilitate this ability to propel the central slider 112 without touching it.

Figure 5A:
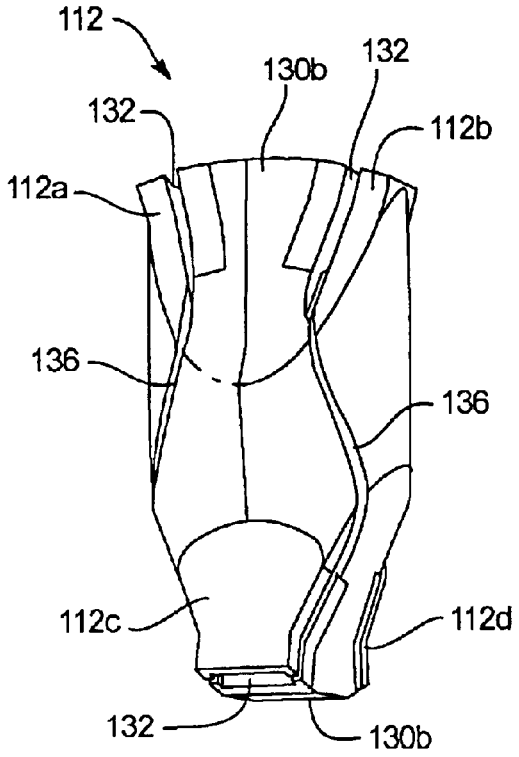
FIGS. 5A through 5C are perspective views of one embodiment of a central slider of a transforming fastener of the present invention.
Figure 5B:
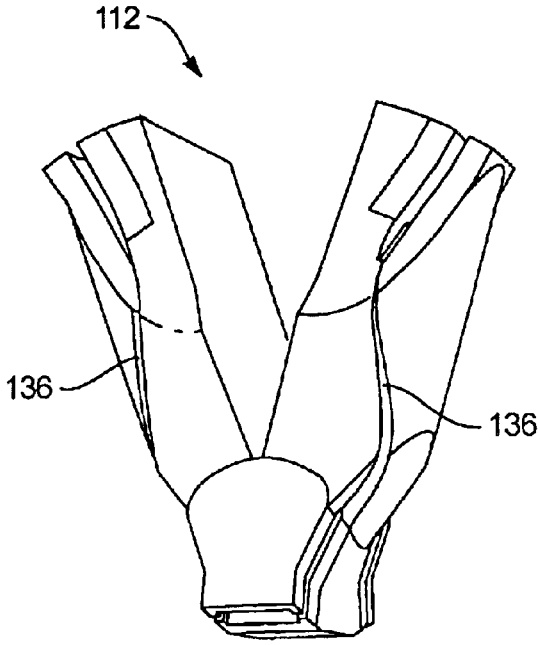
Figure 5C:
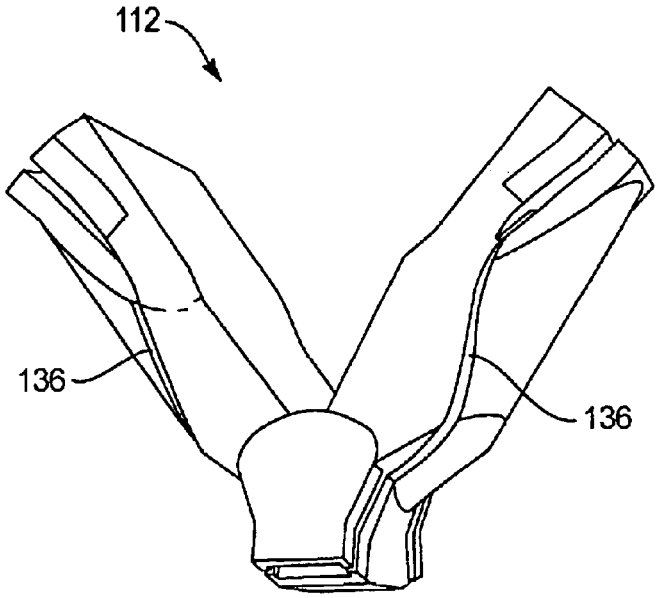

FIG. 5A shows one embodiment of the central slider 112 that has the capability of flaring outwardly by splitting partially apart, as shown in the progression from FIGS. 5A to 5C, when the volume of material 10 near the central slider 112 is pulled at. This flaring capability further facilitates the ability of the central slider 112 to move along the tracks, which, in turn makes it easier for the user to propel the central slider 112 along the tracks without using his hands. Note that the embodiment of the central slider 112 shown in FIGS. 5A through 5C show an example of a central slider 112 that is substantially solid.

Figure 7:
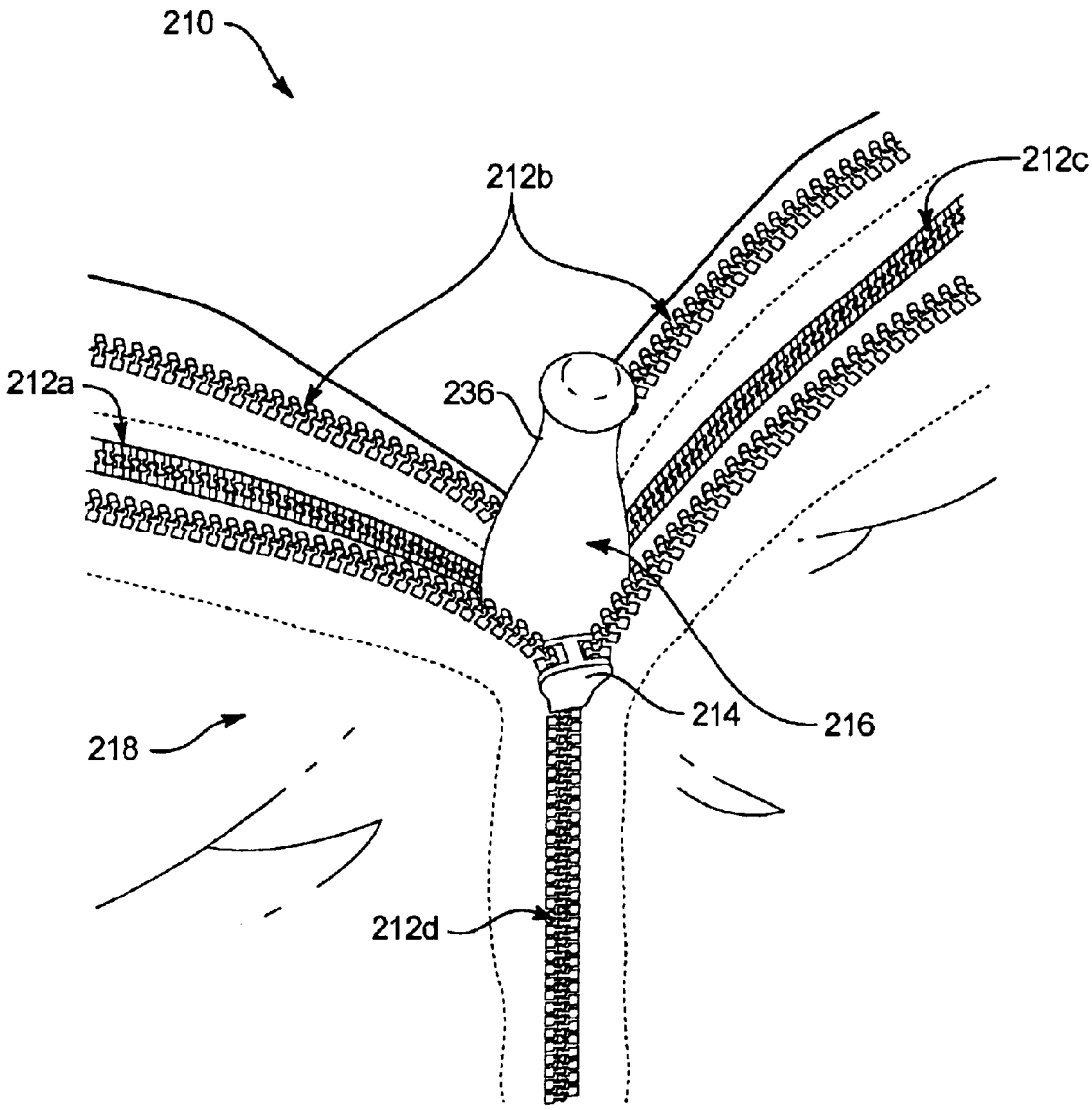
FIG. 7 shows another embodiment of a transforming fastener of the present invention.

FIG. 7 is a perspective view of another embodiment of a transforming fastener 210. This transforming fastener 210 basically comprises four individual tracks, 212*a*, 212*b*, 212*c*, and 212*d* (collectively "212*a*–212*d*"), slider pieces 214*a*, 214*b*, 214*c*, and 214*d* (collectively "214*a*–214*d*") (shown beginning at FIG. 8) on each of the tracks 212*a*–212*d* for fastening or preferably zipping together each of the tracks 212*a*–212*d*, and a central slider connector 216 for centrally connecting each of the slider pieces 214*a*–214*d*. The central connector 216 and/or the slider pieces 214*a*–214*d* comprise possible embodiments of the slider of the transforming fastener 110 of the present invention.

Transforming fastener 210 is attached or sewn to material 218 (comprising part of the volume of material 10) so that when the central connector 216 is pulled in one direction along the tracks, two opposing tracks 212*a* and 212*c* (notice that each track comprises two rows, here shown as zipper teeth) unfasten or unzip, and, simultaneously, the two other opposing tracks 212*b* and 212*d* fasten or zip together. If the central connector 216 were to be pushed in the opposite direction, the tracks that were fastened or zipped together would unfasten or unzip, and the tracks that were unfastened or unzipped would fasten or zip together.

Figure 8:
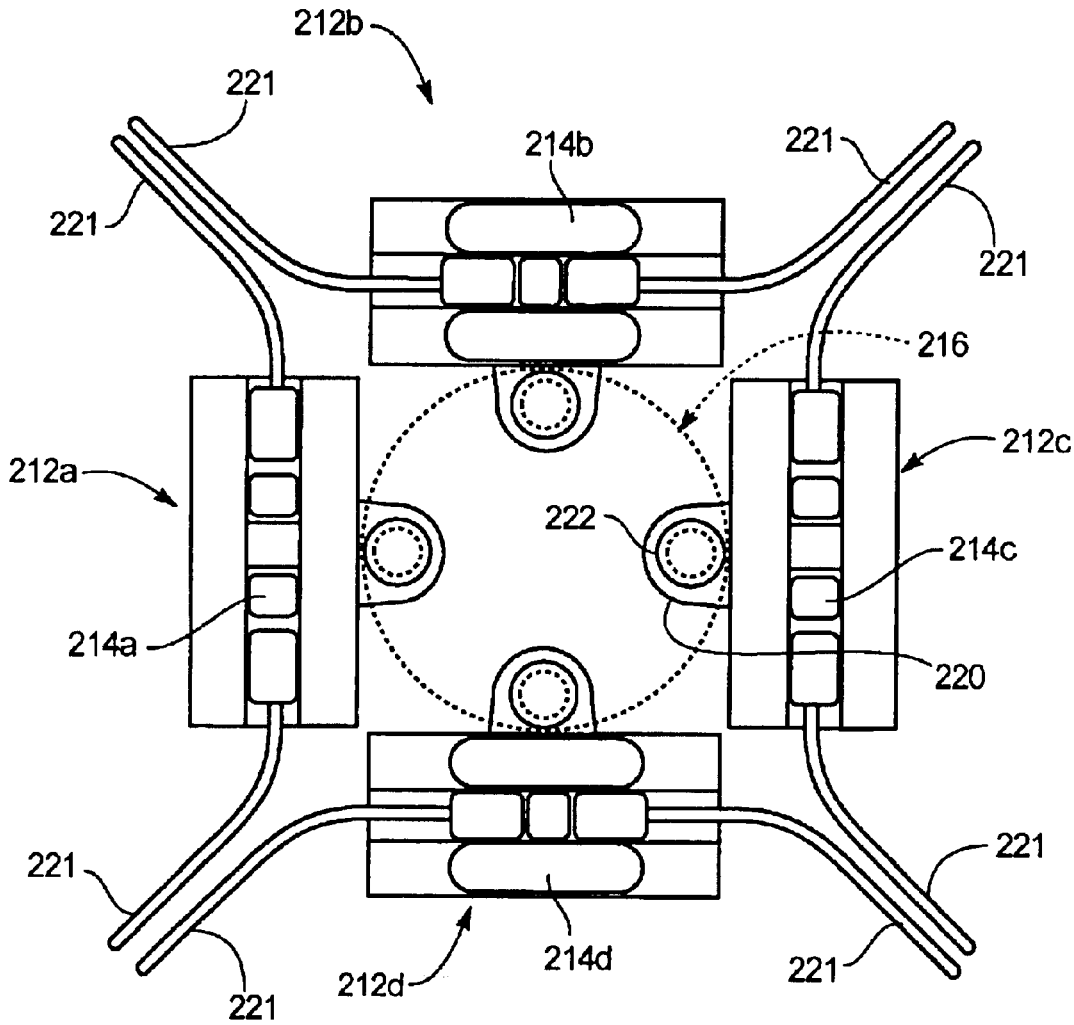
FIG. 8 is a cross sectional plan view of the embodiment of the transforming fastener shown in FIG. 7.

FIG. 8 shows a cross sectional plan view of the transforming fastener 210 of FIG. 7. Shown are four slider pieces 214*a*–214*d* that slide along their respective tracks 212*a*–212*d*. In some embodiments of the present invention, the slider pieces 214*a*–214*d* that are adjacent to each other are oriented in alternating orientations. For example, FIG. 8 shows slider pieces 214*a* and 214*c* to be facing in one direction, and slider pieces 214*b* and 214*d* facing in the opposite direction. This alternating orientation of the slider pieces 214*a*–214*d* causes two of the tracks 212*a*–212*d* to fasten together and two of the tracks 212*a*–212*d* to simultaneously unfasten when the transforming fastener 210 is either pushed or pulled.

Figure 9A:
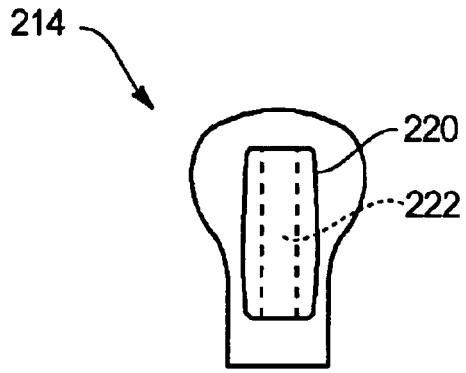
FIGS. 9A through 9C show various views of one embodiment of a slider piece of a transforming fastener, FIG. 9A being an elevational view of the front of the slider piece, FIG. 9B a side elevational view of the slider piece, and FIG. 9C being a top plan view of the slider piece embodiment.
Figure 9B:
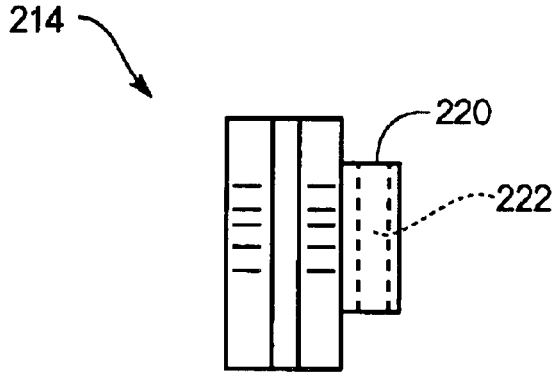
Figure 9C:
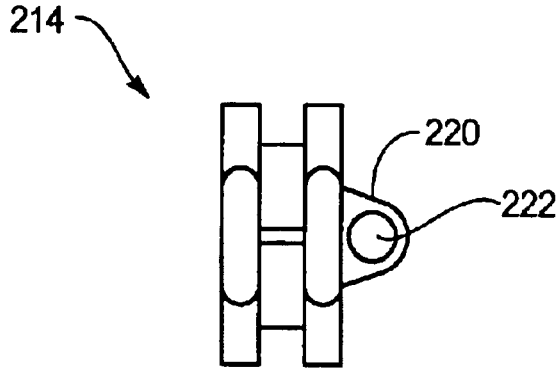
Figure 10A:
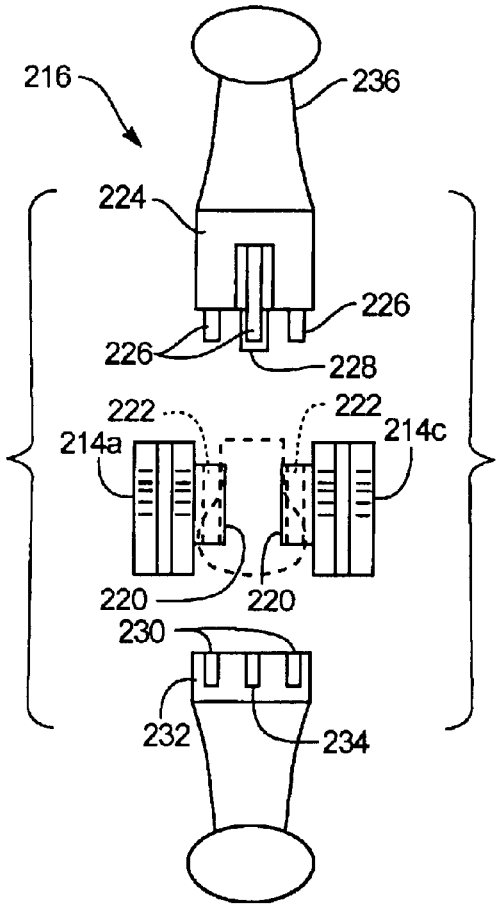
FIG. 10A is an exploded elevational view of one embodiment of a transforming fastener of the present invention.
Figure 10B:
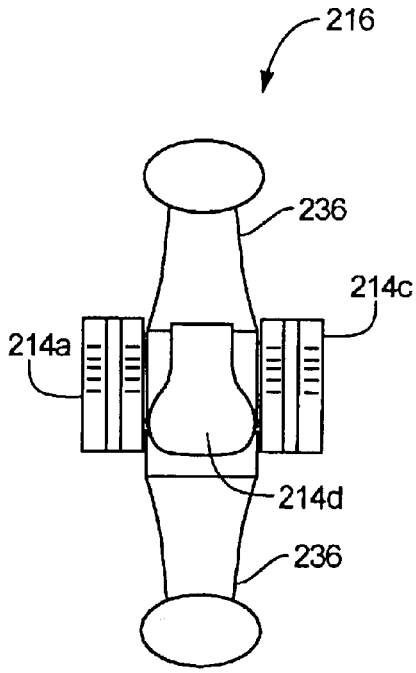
FIG. 10B shows the parts in FIG. 10A when connected together.
Figure 11A:
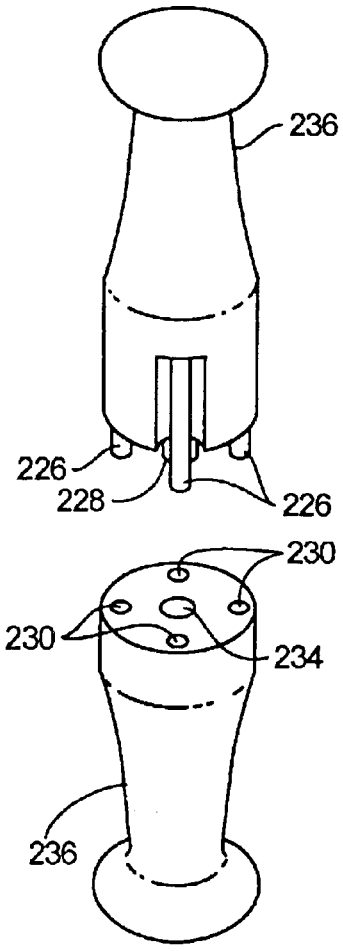
FIG. 11A is a perspective view of part of the transforming fastener shown in FIGS. 10A and 10B.
Figure 11B:
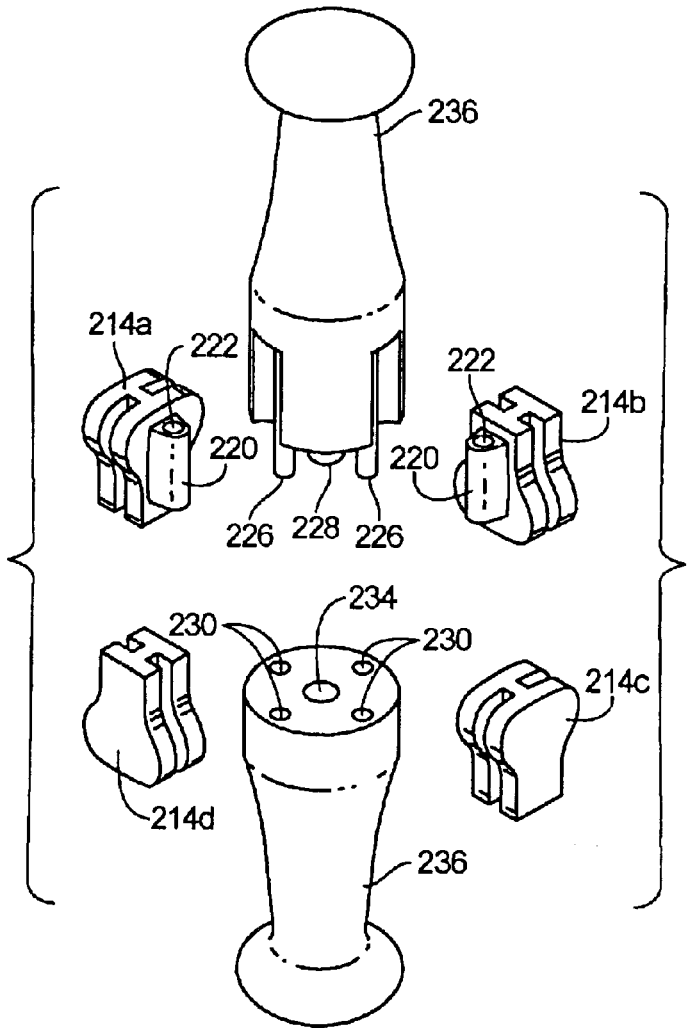
FIG. 11B is a perspective view of the embodiment shown in FIG. 10A.

FIG. 8 also shows a cross section of the central connector 216 to which the slider pieces 214*a*–214*d* are connected in accordance with some embodiments of the present invention. The slider pieces 214*a*–214*d* may be connected to the central connector 216 in any appropriate way. For example, the central connector 216 and slider pieces 214*a*–214*d* may be all integrally formed—instead of comprising parts that are initially separate and then subsequently coupled together. In the embodiment shown in FIG. 8, the slider pieces 214*a*–214*d* each have an extension 220 (commonly known in the zipper manufacturing industry as a "nose piece") by which the slider pieces 214*a*–214*d* are connected to the central connector 216. Note that extension 220 has a hole 222 (shown also in dotted lines in FIGS. 9A and 9B). As can be seen in the various views of the slider piece 214 (slider piece 214 being representative of one of the slider pieces 214*a*–214*d*) in FIGS. 9A, 9B, and 9C, this particular extension 220 is specially molded because the hole 222 is a longitudinally oriented hollow instead of a horizontally oriented hollow. However, in some embodiments, it may instead be more cost effective to produce the transforming fastener 210 using standard zipper slider moulds.

In some embodiments of the present invention, the slider pieces 214*a*–214*d* are oriented in a ring-like formation, as shown in FIG. 8. Moreover, each track 212*a*–212*d* has edges 221 that are attached or sewn to the edges 221 of the adjacent track. As such, the orientation of the slider pieces 214*a*–214*d* causes two opposing tracks (for example, tracks 212*a* and 212*c*) to zip together and the other two opposing tracks (for example, 212*b* and 212*d*) to simultaneously unzip when the central connector 216 is either pushed or pulled.

As shown in FIGS. 10A through 11B, one embodiment of the central connector 216 may comprise a male piece 224 and a female piece 232 wherein the male piece 224 has peripheral extensions 226 that, during the assembly process, are inserted into the holes 222 of the slider piece extensions 220. The peripheral extensions 226 are then inserted into complementary peripheral receiving holes 230 in the female piece 232. A central extension 228 on the male piece 224 is also received by a central receiving hole 234 in the female piece 232. The central extension 228 and/or the peripheral extensions 226 are secured into their respective holes 234 and 230 so that the male piece 224 and the female piece 232 are securely attached, thereby ensuring a reliable connection between the slider pieces 214*a*–214*d* and the central connector 216. In some embodiments, the central extension 228 and/or the peripheral extensions 226 may have a flange around the tip (not shown), which allows the male piece 224 to snap or lock into the female piece 232.

The central connector 216 also comprises a handle (various examples of which are identified by number 236 in FIGS. 7 and 10A through 11B, and by the combination of the elements identified by numbers 242, 248, and 250 in FIGS. 12A and 12B) whereby the central connector 216 can be pushed or pulled. The handle on the central connector 216 may comprise a surface on the central connector 216 or may be an additional piece attached to the central connector 216. The handle can be shaped in any suitable manner that allows a person to either push the handle in a first direction along the tracks, thereby sliding the central connector 216 in the first direction along the tracks 212*a*–212*d*, or pull the handle in an opposite second direction, thereby sliding the central connector 216 in the opposite direction along the tracks 212*a*–212*d*. The central connector 216 need not include a handle; alternatively, it may include any number of handles.

In the embodiment shown in FIGS. 10A through 11B, two handles 236 (the handles shown here each being shaped like a milk bottle) are available to manipulate the central connector 216. When incorporated into a volume of material 10, for example, this central connector 216 might have one handle 236 extending into the interior of the volume of material 10, and one handle 236 extending exteriorially away from the interior of the volume of material 10. Thus, a user is able to propel the central connector 216 by accessing it from within the interior of the volume of material 10 (via the interior handle 236); the user may also propel the central connector 216 by accessing it from a point exterior to the volume of material 10 (via the exterior handle 236). FIG. 7 illustrates an example of such a double-handled embodiment. However, note that only the exterior handle 236 is visible in FIG. 7.

Figure 12A:
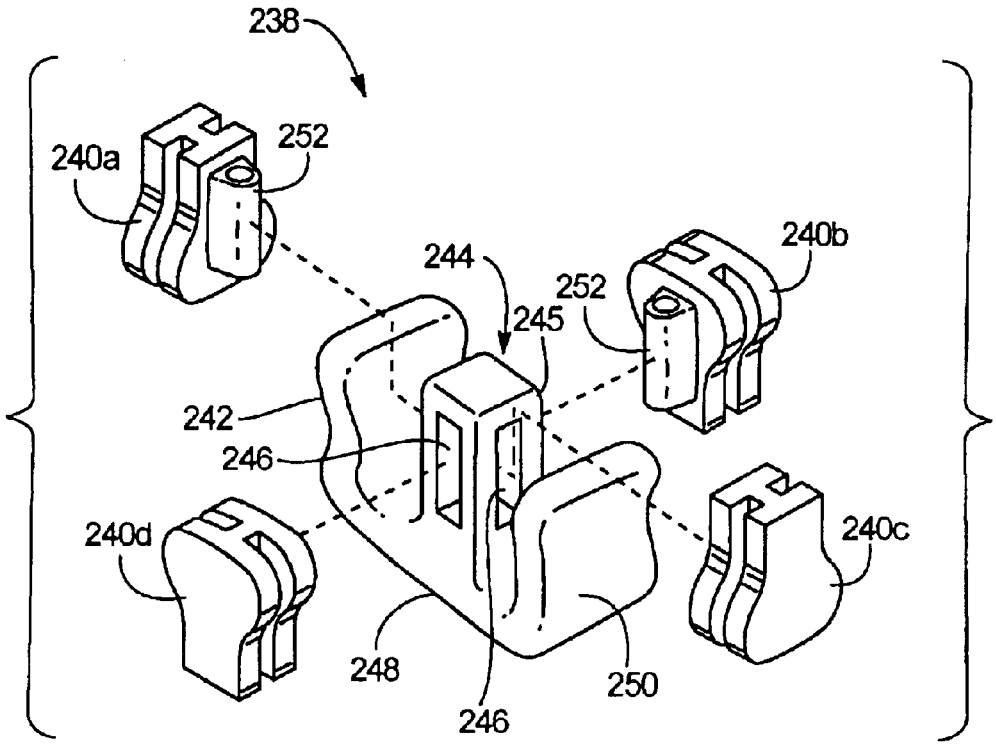
FIG. 12A is an exploded perspective view showing one embodiment of the slider pieces and the central connector of a transforming fastener.
Figure 12B:
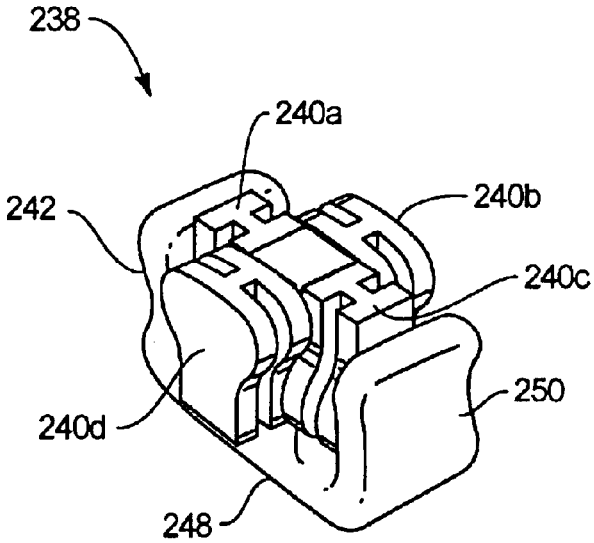
FIG. 12B is a perspective view of the embodiment shown in FIG. 12A when the pieces in FIG. 12A are assembled together.

FIGS. 12A and 12B illustrate an embodiment of a central connector 238 that is integrally formed with slider pieces 240*a*, 240*b*, 240*c*, and 240*d* (collectively "240*a*–240*d*"), preferably using the process of insert molding. Here, the central connector 238 includes a central piece 244 that holds the slider pieces 240*a*–240*d*. The central piece 244 and the slider pieces 240*a*–240*d* can be any shape; this particular central piece 244 has a center post 245, a first side 242, a second side 250, and a bottom surface 248 (the latter three elements of which can together comprise a handle, as explained further herein). The center post 245 further includes slots 246 for receiving extensions 252 on the slider pieces 240*a*–240*d*. Assembling this central connector 238 via insert molding involves placing the slider pieces 240*a*–240*d* within a mould and shooting plastic around the slider piece extensions 252 to create the plastic central piece 244, the result being an integrally formed central connector 238 comprising the central piece 244 and the slider pieces 240*a*–240*d*. Note that in some of the embodiments, the central piece 244 is plastic, and the slider pieces 240*a*–240*d* are metal.

It was mentioned earlier that the embodiment in FIGS. 12A and 12B has a handle that is formed integrally with the central connector 238 and comprises a contour or surface of the central connector 216. This handle is comprised of sides 242 and 250 and/or the bottom surface 248. The handle of this embodiment is designed to be incorporated in material 218 so that the sides 242 and 250 and bottom surface 248 are exteriorly located with respect to the interior of the volume enclosed by the material 218. In other words, if this handle were substituted for the handle 236 in FIG. 7, the bottom surface 248 is what would be visible in the drawing. In order to move the central connector 238 along the tracks 212*a*–212*d*, a user can grasp the handle of FIGS. 12A and 12B at sides 242 and 250 with a thumb and forefinger. The user can also push against the bottom surface 248 to move the central connector 238 along the tracks 212*a*–212*d*.

The transforming fastener 210, being a specific embodiment of the transforming fastener 110 of the present invention, can likewise transform the volume of material 10 into alternative configurations such as from a sleeping bag to a jumpsuit or from a baby bunting to a baby jumpsuit or pajamas. For example, FIGS. 1A and 1B show three transforming fasteners 110 incorporated into a volume of material 10 having material comprising arm sleeves 12 and pant legs 14. If the transforming fasteners 110 in FIG. 1A were the specific transforming fasteners 210, the transforming fasteners 210 would be in a state wherein two opposing tracks within each transforming fastener 210 are zipped closed so that the volume of material 10 is useful as a sleeping bag or baby bunting, for example. Of course, since the slider pieces 214*a*–214*d* in the transforming fasteners 210 are in alternating orientations, the other two tracks within each transforming fastener 210 are in an unzipped state in FIG. 1A.

Continuing with the analogy, if the transforming fasteners 110 in FIG. 1B were the specific transforming fasteners 210, then the transforming fasteners 210 that were closed in FIG. 1A would be open in FIG. 1B; those that were open in FIG. 1A would be closed in FIG. 1B. As a result, the volume of material 10 in FIG. 1B would be useful as a jumpsuit or as baby pajamas, for example.

FIGS. 13A through 13F show various embodiments of the present invention, herein sometimes referred to as "suits," each of the Figures showing only the front sides of the volumes of material 10. The transforming fasteners 110 at the back sides of these suits mirror those shown here from the front sides, except that the transforming fasteners 110 located between the legs 14 do not operate (that is, compartmentalize) along the entire length of the suits but only operate from the bottom of the suits (see point 112 in FIGS. 13A, 13C, and 13E) to the crotch of the legs 14 (see point 112 in FIGS. 13B, 13D, and 13F). It should be noted that 112 represents the central slider, or more generally, the slider of the transforming fastener 110 of the present invention. It should also be noted that the transforming fasteners 110 shown in FIGS. 13A through 13F can represent the transforming fastener 210 or any other particular embodiment of the transforming fastener 110 of the present invention.

In the preferred embodiments of the present invention, two of the matable rows of each transforming fastener 110 are coupled to the front side of the volume of material 10 as shown in FIGS. 13A through 13F, and two of the matable rows are coupled to the back side immediately behind the front matable rows. In some embodiments, the tracks are coupled to the inseams of the pant legs 14 as shown. In other words, one method of assembly involves first obtaining a pre-existing volume of material 10 having inseams (such as a jumpsuit), and then coupling the transforming fasteners 110 to the inseams. However, assembly can include cutting a new slit in a desired location in the volume of material 10, and then coupling the transforming fasteners 110 to that slit.

Figure 13D:
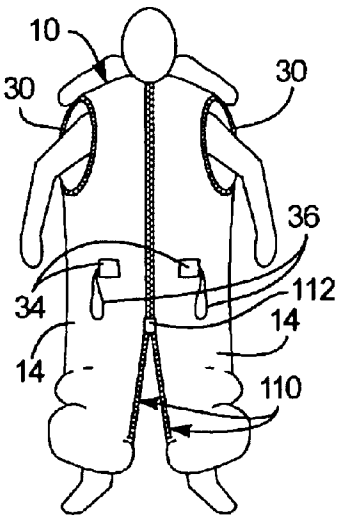
FIGS. 13A through 13F illustrate various embodiments of the present invention.
Figure 13C:
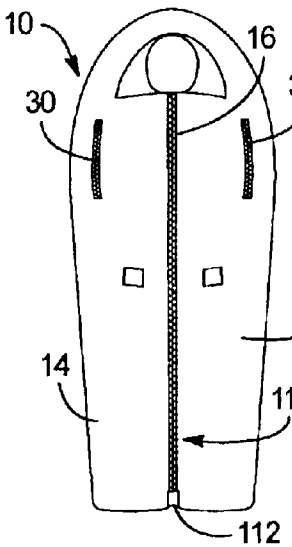
Figure 13B:
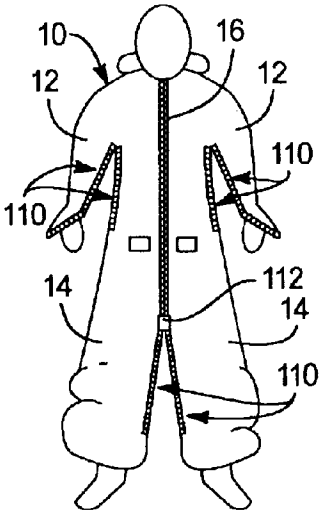
Figure 13A:
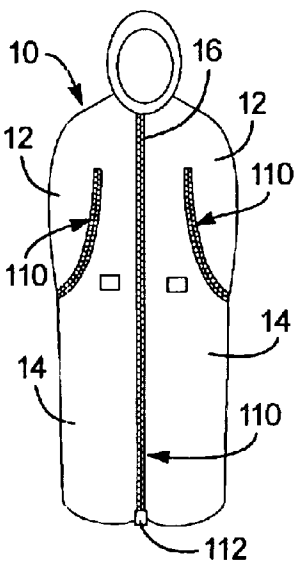

FIGS. 13A through 13D show a suit 10 having a transforming fastener 110 in the bottom end of the suit between the material comprising the legs 14, and a transforming fastener 110 at the top end of the suit for each arm sleeve 12. These embodiments might be suitable, for example, for transforming a sleeping bag (such as those shown in FIGS. 13A and 13C) to a jumpsuit (such as those shown in FIGS. 13B and 13D). FIGS. 13C and 13D also show optional standard zippers 30 placed in the volume of material 10 near the wearer's shoulders to allow the wearer's arms to exit the volume of material 10 when desired. FIG. 13D additionally shows an optional tightening device 36 that allows the user to secure the volume of material 10 in position on the user's body. The tightening device 36 is here shown as a pullable cord that exits from flaps 34 coupled to the volume of material 10.

Figure 13F:
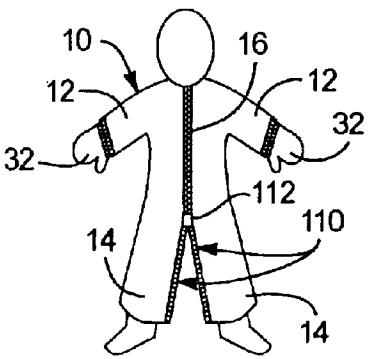
Figure 13E:
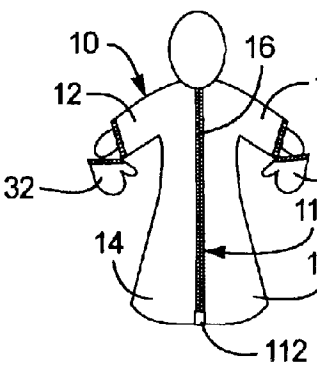
Figure 14A:
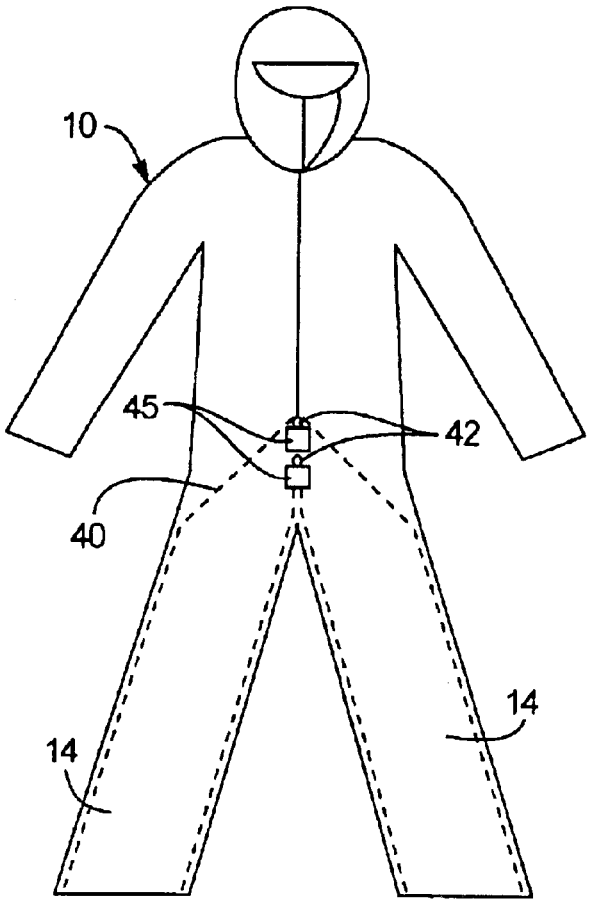
FIGS. 14A, 14B, 15A, and 15B illustrate a cinching system in accordance with some embodiments of the present invention.
Figure 14B:
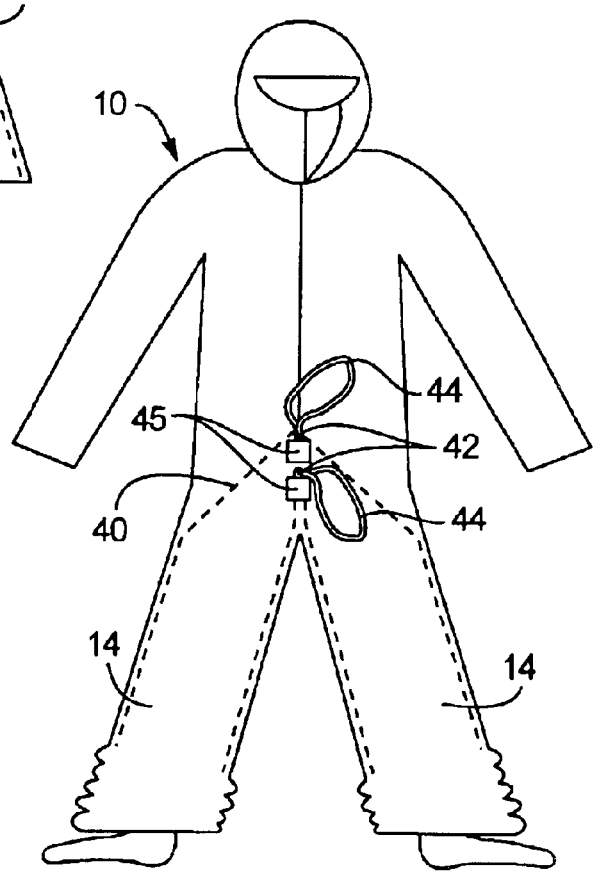

FIGS. 13E and 13F show some embodiments of the present invention wherein there are no transforming fasteners 110 in the arms 12. These embodiments might be suitable, for example, for transformations from a suit comprising a baby bunting (such as that shown in FIG. 13E) to a baby jumpsuit or baby pajamas (such as that shown in FIG. 13F). FIGS. 13E and 13F also illustrate optional detachable hand coverings or mittens 32 coupled to the end of the arm sleeves 12. The mittens 32 are here shown as being coupled to the end of the arm sleeves 12 via standard zippers located at the wrists; however the mittens 32 may be coupled to the sleeves 12 in any manner.

In some embodiments of the present invention, such as the embodiment in FIG. 1B discussed near the beginning of this Detailed Description, the wearer's hands are always encased by the volume of material 10. In other embodiments, such as those shown in FIGS. 13B and 13E, the volume of material 10 has arms 12 that have openings at the wrists through which the wearer's hand may extend. Preferably, the openings are openable by standard zippers, as shown; however, other means may be used to allow the user's hand to exit or extend from the volume of material 10.

It should also be noted that FIGS. 13A through 13F show a standard zipper 16 which shares a track with one of the transforming fasteners 110 in accordance with some embodiments of the present invention. In the embodiments shown in FIGS. 13A through 13F, the standard zipper 16 shares a track with the transforming fastener 110 that divides the volume of material 10 into pant legs. The standard zippers 16 can also share tracks with transforming fasteners 110 that divide the volume of material 10 into arm sleeves 12.

In the embodiments shown in FIGS. 13A through 13F, the standard zipper 16 can be used to zip open the volume of material 10 starting from the top end of the volume of material 10 and stopping at the bottom end of the volume of material 10 near the user's feet. As such, the standard zipper 16 can be used to allow a wearer to enter or exit the volume of material. Note, however, as was mentioned earlier, the transforming fastener 110 with which the standard zipper 16 shares a track does not divide the volume of material 10 past the crotch of the pant legs 14. In other words, the slider 112 can move from the bottom of the volume 10 up to the crotch of the pant legs 14. However, the standard zipper 16 can move from the top of the volume 10 past the crotch and all the way down to the bottom of the volume 10. The slider 112 stops at the crotch because the tracks of the transforming fastener 110 at the back of the volume of material 10 stop at the crotch in the embodiments shown. In some embodiments, a standard zipper 16 can additionally or alternatively be similarly shared with a track at the back of the volume of material 10.

It can be observed from the transformations shown in FIGS. 1A, 1B, and 13A through 13F that the transformations caused by the transforming fasteners 110 do not change the quantum of volume enclosed by the volume of material 10; the transformations merely compartmentalize or divide up the volume. However, not all embodiments require a fixed quantum of enclosed volume. For example, in embodiments wherein the central slider 112 is designed to be removable from some of the rows, a first volume might be attachable to a second volume via the central slider 112 to create a third volume equal to the sum of the first and second volumes.

FIGS. 14A through 15B illustrate a cinching system incorporated into the volume of material 10 in some embodiments of the present invention. The cinching system allows the user wearing the volume of material 10 to vary the length of pant legs 14 by pulling on one or more cords 40. The cords 40 are coupled or sewn to the bottom of each pant leg 14, preferably at or near points 52 (see FIG. 15B), and run loosely along the insides of the fabric comprising the pant legs 14, preferably through paths created by folds in an interior fabric lining 50 (see FIG. 15A) coupled to the volume of material 10. The cords 40 exit through one or more holes 42 so that the user can pull on the cords 40 by means of one or more pulls 44 (see FIG. 14B), thereby causing the pant legs 14 to cinch upwards as in FIG. 14B. Optional flaps 45 may be coupled to the volume of material 10 to serve as a cover for the pulls 44.

Figure 15A:
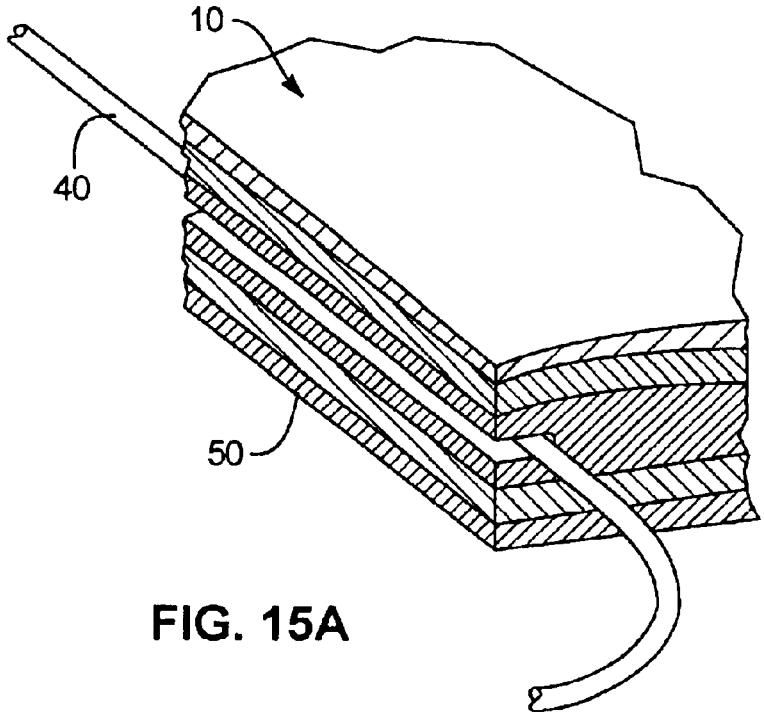
Figure 15B:
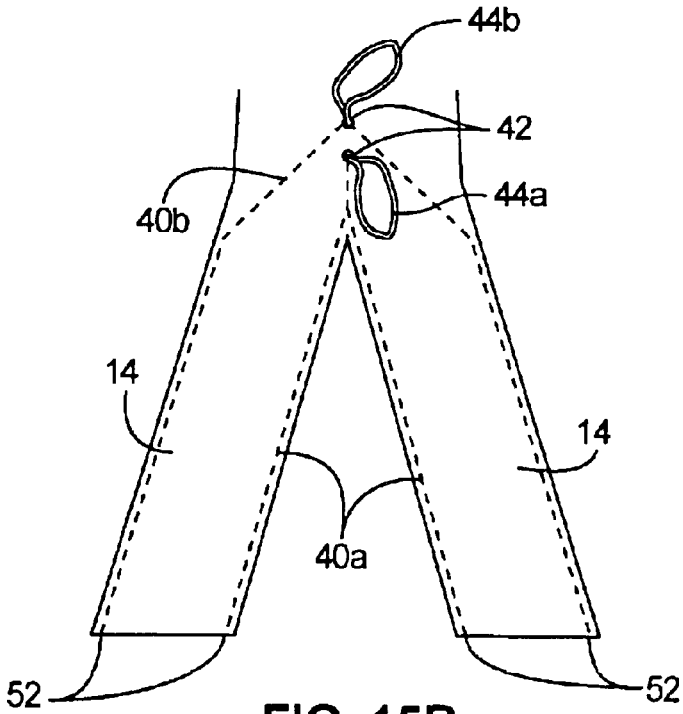

The cords 40 of the present invention can be placed in the pant legs 14 so as to allow the user to selectively cinch up either of the pant legs 14 separately. Also, as illustrated in FIG. 15B, the cords can be placed in the pant legs 14 so that a first pull 44*a* will cinch the cords 40*a* located near the inseam of the pant legs 14, and a second pull 44*b* will separately cinch the cords 40*b* located near the exterior seam or portion of the pant legs 14. In some embodiments, pulls 44*a* and 44*b* are combined into a single pull that cinches all of the cords 40 located both at the inseam and at the exterior portions of the pant legs 14.

In summary, the present invention provides various types of suits that allow a user or occupant to conveniently transform the configurations of the suit without having to exit the suit and expose himself or herself to the environment. In the outdoor context, these suits might comprise a sleeping bag that is transformable, without requiring the user to be exposed to cold temperatures, into a jumpsuit that the user can walk around in and wear as daytime clothing. In other contexts, the suits of the present invention might comprise a baby bunting that can easily transform into a baby jumpsuit having legs so that a baby can easily be placed into a car seat without having to remove the baby bunting from the baby. The various embodiments of the present invention provide unparalleled flexibility, versatility, and convenience to the user.

It should be emphasized that the present invention is not limited to the specific examples described in this Detailed Description. For example, the sliders, slider pieces, slider parts, central slider, central connector, tracks, handle, volume of material, and various other parts of the present invention all may be made of any material and be made into any shape that will accomplish the functions of the present invention. Also, any two or more of the various elements of the present invention, including the latter listed elements, may be manufactured as a single whole part instead of as pieces manufactured separately and then subsequently coupled together.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A system comprising:

a volume of material having a first formation wherein the volume is substantially undivided by the material, and a second formation wherein the volume is substantially divided by the material, said first formation being shaped so as to enclose a user's legs together in one compartment, said second formation being divided so as to form compartments suitable for separately enclosing each of the user's legs;

a transforming fastener coupled to the volume of material, said transforming fastener comprising:

a plurality of tracks, each track comprising a pair of matable rows; and a slider slidably coupled to the rows, the slider transforming said volume of material, when sliding along said rows, between said first and second formations by fastening one of the pair of rows while simultaneously unfastening another of the pair of rows.

2. The system of claim 1 wherein said second formation comprises pant legs, said pant legs further comprise inseams, and said tracks are coupled to the inseams.

3. The system of claim 1 wherein said second formation comprises pant legs, said transforming fastener comprises a first end and a second end, said first end is placed at the crotch of said pants, and said second end is placed near the general location of the user's feet.

4. The system of claim 1 wherein said first formation completely encloses the bottom of the user's feet.

5. The system of claim 1 further comprising a standard zipper coupled to the volume of material, said standard zipper allowing the user's foot to exit the volume of material.

6. The system of claim 1 wherein said slider shares one of said tracks with a standard zipper slider that allows the user to zip and unzip the track to allow the user to enter and exit the volume of material.

7. The system of claim 1 wherein said second formation comprises pant legs and the system further comprises a cinching system for allowing the user wearing said volume of material to pull up the pant legs to a desired length, said cinching system comprising:

a pathway that runs through the volume of material;

a cord that runs loosely through said pathway;

at least one hole through which the cord exits; and at least one pull on said cord that the user can pull on to cinch the pant legs up.

8. The system of claim 1 wherein stretchable fabric is placed between the tracks and the volume of material to facilitate movement of the slider along the matable rows.

9. The system of claim 1 further comprising another transforming fastener that transforms a portion of said volume of material into arm sleeves.

10. The system of claim 1 wherein said volume of material further comprises arm sleeves and a mitten coupled to each of the arm sleeves.

11. The system of claim 1 further comprising means for propelling the slider along the tracks.

12. The system of claim 1 wherein the movement of the slider along the rows causes the rows to interchange with each other.

13. The system of claim 1 wherein the volume of material transforms from the first formation into the second formation when the user wearing the volume of material spreads his legs apart.

14. The system of claim 1 wherein said slider has a contour upon which the user may both push and pull in order to propel the slider along the matable rows.

15. The system of claim 1 wherein said slider is coupled to at most four tracks and said slider comprises four zipper sliders affixed to a central connector, each of said four zipper sliders being coupled to one of the four tracks.

16. The system of claim 1 wherein said slider comprises a central slider comprising:

a first end and a second end, an angled opening at each end of the central slider, said angled openings being shaped to facilitate rotation of the tracks within the central slider; and a plurality of paths in said central slider, said paths through which the tracks travel when the central slider slides along the tracks, the paths thereby causing the rows of the tracks to interchange.

17. A system comprising:

a volume of material wearable by a user, said material comprising a bag for encasing the user's legs and feet, said bag comprising a front side, a back side, and a bottom end;

a transforming fastener coupled to the bag, said transforming fastener comprising:

a plurality of tracks, each track comprising a pair of matable rows, two of the matable rows being coupled to the front side of the bag, and two of the matable rows being coupled to the back side of the bag; and a slider slidably coupled to the rows, the slider dividing said bag, when sliding along said rows, into pant legs by interchanging the matable rows on said front side with the matable rows on said back side.

18. The system of claim 17 wherein said pant legs further comprise inseams, and said tracks are coupled to and along the inseams.

19. The system of claim 17 wherein said bottom end encloses the user's feet and said bottom end comprises durable material that protects the user's feet as the user walks around.

20. The system of claim 17 further comprising two standard zippers placed at the bottom end of the bag, wherein the user may unzip the standard zippers in order to allow the user's feet to exit the volume of material.

21. The system of claim 17 wherein said slider shares one of said tracks with a standard zipper slider that allows the user to unzip and zip said front side and thereby enter and exit said bag.

22. The system of claim 17 wherein said slider shares one of said tracks with a standard zipper slider located on said front side, and one of said tracks with a standard zipper slider located on said back side, said standard zipper sliders allowing the user to unzip and zip the front and back sides and thereby enter and exit said bag.

23. The system of claim 17 further comprising a means for allowing the user wearing said volume of material to pull up the pant legs to a desired length.

24. The system of claim 17 wherein said volume of material further encases the user's arms and torso, and said system further comprises a second transforming fastener for dividing the volume of material into sleeves for the user's arms, said second transforming fastener comprising tracks that begin near the user's wrist and end near the user's armpit.

25. The system of claim 17 wherein the volume of material transforms from the bag to the pant legs without use of the user's hands.

26. The system of claim 25 wherein said slider can split partially apart to facilitate movement of the slider along the tracks when the user spreads his legs apart.

27. The system of claim 17 wherein the said slider has a curved contour upon which the user may push and pull in order to propel the slider along the matable rows.

28. The system of claim 17 wherein said slider is coupled to at most four tracks and said slider comprises four zipper sliders affixed in a ring-like formation to a central connector, each of said four zipper sliders being coupled to one of the four tracks.

29. The system of claim 17 wherein said slider comprises a central slider comprising:

a first end and a second end;

an angled opening at each end of the central slider, said angled openings being shaped to facilitate rotation of the tracks within the central slider; and a plurality of paths in said central slider, said paths through which the tracks travel when the central slider slides along the tracks, the paths thereby causing the rows of the tracks to interchange, said central slider being shaped so that the rotation of the tracks within said central slider begins while the rows are being disconnected from each other in preparation for said interchange.

30. The system of claim 17 wherein the volume of material has the same quantum of volume before and after said interchanging takes place.

31. The system of claim 17 further comprising a tightening device coupled to the volume of material, said tightening device allowing the user to secure the volume of material in a position on the user's body.

32. The system of claim 17 wherein said volume of material further encases the user's arms and torso, and wherein the system further comprises a standard zipper located near the user's shoulder for allowing the user's arm to exit the volume of material.

33. The system of claim 17 wherein said rows comprise zipper teeth.

34. A system comprising:

a volume of material comprising a bag for encasing a user's legs;

a plurality of tracks coupled to the volume of material, each track comprising a pair of matable rows; and a means, coupled to said volume of material, for dividing said bag into compartments comprising pant legs.

35. The system of claim 34 further comprising a standard zipper coupled to the volume of material, said standard zipper allowing the user's foot to exit the volume of material.

36. The system of claim 34 further comprising a means for allowing the user wearing said volume of material to cinch up the pant legs to a desired length.

37. The system of claim 34 further comprising arm sleeves coupled to said volume of material.

38. The system of claim 34 further comprising a standard zipper coupled to the volume of material near the user's shoulder, said standard zipper allowing the user's arm to exit the volume of material when said zipper is unzipped.

39. The system of claim 34 wherein the volume of material has the same quantum of volume before and after said dividing takes place.

40. A system comprising:

a suit wearable by a user, said suit comprising arm sleeves for encasing the user's arms, and a bag for encasing the user's legs and feet, said suit comprising a front side, a back side, and a bottom end;

a transforming fastener coupled to the suit, said transforming fastener comprising:

a plurality of tracks, each track comprising a pair of matable rows, two of the matable rows being coupled to the front side of the suit, and two of the matable rows being coupled to the back side of the suit; and a slider slidably coupled to the rows, the slider dividing said bag, when sliding along said rows, into pant legs by interchanging the matable rows on said front side with the matable rows on said back side, said rows having a first end located at the crotch of the pant legs, and a second end located at the bottom end of said suit.

41. The system of claim 40 further comprising a standard zipper slider coupled to one of said tracks, said standard zipper slider allowing a person to zip and unzip said suit to allow the wearer to enter and exit said suit.

42. The system of claim 41 further comprising a standard zipper on each of said arm sleeves, said standard zippers allowing the wearer's arms to exit the suit through openings created in the suit when the standard zippers are unzipped.

43. The system of claim 42 wherein said arm sleeves further comprise mittens coupled thereto.

44. A system comprising:

a suit wearable by a user, said suit comprising a volume of material encasing the user's arms, legs, and feet, said suit comprising a top end and a bottom end;

three transforming fasteners coupled to said suit, the first transforming fastener of which transforms the bottom end of said suit into pant legs, the second and third transforming fasteners of which transform the top end of said suit into arm sleeves, said transforming fasteners comprising:

a plurality of tracks, each track comprising a pair of matable rows;

a slider slidably coupled to the rows, the slider compartmentalizing said volume of material, when sliding along said rows, by fastening together some of the matable rows while simultaneously unfastening other of the matable rows.

45. The system of claim 44 further comprising a standard zipper placed on each of the arm sleeves to allow the user's arms to exit the suit.

46. The system of claim 44 further comprising a means for cinching pant legs up to a length desired by the user.

47. The system of claim 44 further comprising two standard zippers placed on the bottom of said suit to allow the user's feet to exit the suit.

48. The system of claim 44 further comprising a standard zipper slider that shares one of the tracks so that the user can thereby enter and exit the suit.

49. A method comprising:

obtaining a volume of material having inseams;

obtaining a transforming fastener, said transforming fastener comprising:

a plurality of tracks, said tracks each comprising two matable rows;

a slider for fastening some of the rows while simultaneously unfastening other of the rows, said slider being coupled to said tracks; and coupling said transforming fastener to said inseams.

50. The method of claim 49 wherein the volume of material comprises pant legs, and the inseams are located on the pant legs.

51. The method of claim 49 wherein the volume of material comprises arm sleeves, and the inseams are located on the arm sleeves.

52. The method of claim 49 further comprising creating said slider as an integrally molded piece.

53. The method of claim 49 further comprising creating said slider by coupling together individual pieces.

54. A method comprising:

obtaining a volume of material;

cutting a slit in said material;

obtaining a transforming fastener, said transforming fastener comprising:

a plurality of tracks, said tracks each comprising two matable rows; and a slider for fastening some of the rows while simultaneously unfastening other of the rows, said slider being coupled to said tracks; and coupling the tracks of said transforming fastener to said slit.

* * * * *